US005791093A

United States Patent [19]

Diamond

[11] Patent Number: 5,791,093

[45] Date of Patent: Aug. 11, 1998

[54] SLATWALL PANEL AND METHOD OF ASSEMBLING SAME

[75] Inventor: Gary C. Diamond, Charleston, S.C.

[73] Assignee: Goer Manufacturing Company, Inc., North Charleston, S.C.

[21] Appl. No.: 820,583

[22] Filed: Mar. 19, 1997

[51] Int. Cl.[6] ..... E04B 2/60

[52] U.S. Cl. ..... 52/36.5; 52/506.01; 52/539; 52/546; 52/551; 52/588.1; 52/592.1; 52/731.7; 52/745.1; 52/745.13; 52/745.2; 52/747.1

[58] Field of Search ..... 52/36.4, 36.5, 52/506.01, 588.1, 589.1, 592.1, 592.6, 731.7, 745.1, 745.12, 745.13, 745.2, 747.1, 539, 546, 551

[56] References Cited

U.S. PATENT DOCUMENTS

| | | | |
|---|---|---|---|
| 3,698,565 | 10/1972 | Weber . | |
| 4,159,601 | 7/1979 | Ebert et al. . | |
| 4,323,163 | 4/1982 | Johns | 211/189 |
| 4,450,970 | 5/1984 | Shepherd | 52/36.5 X |
| 4,603,068 | 7/1986 | Hunter | 52/588.1 X |
| 4,607,753 | 8/1986 | Radek | 52/36.5 X |
| 4,674,240 | 6/1987 | Strausheim . | |
| 4,694,965 | 9/1987 | Parnell . | |
| 4,809,479 | 3/1989 | Tierno et al. . | |
| 4,825,601 | 5/1989 | Halverson . | |
| 4,961,295 | 10/1990 | Kosch, Sr. et al. . | |
| 5,018,323 | 5/1991 | Clausen | 52/36.4 |
| 5,105,952 | 4/1992 | Krattiger . | |
| 5,185,193 | 2/1993 | Phenicie et al. | 52/588.1 X |
| 5,224,610 | 7/1993 | Veazey . | |
| 5,228,579 | 7/1993 | Kaufman . | |
| 5,409,120 | 4/1995 | Miller et al. | 52/588.1 X |

*Primary Examiner*—Christopher Kent
*Attorney, Agent, or Firm*—Laff, Whitesel, Conte & Saret, Ltd.

[57] ABSTRACT

A slatwall panel having a plurality of horizontally-oriented, vertically arrayed extruded slatwall members which define recesses from which standard one-quarter inch offset hardware and display fixtures may be hung. A slidably connected tongue and claw connection is provided for vertically adjacent members. A method of forming a panel of such members on a wall is also described. In one form, the panel is preassembled. In the other, it is assembled in situ.

9 Claims, 3 Drawing Sheets

SLATWALL PANEL AND METHOD OF ASSEMBLING SAME

BACKGROUND OF THE INVENTION

A wide variety of slatwall configurations have been designed and developed. Many are of a modular construction which is to say that each of a plurality of vertically stacked modules define a slot or slots or hooks on or in which complementary forwardly extending brackets or fixtures may be positioned for support of goods or the like to be displayed.

In some such prior art slatwall constructions, as represented by Weber, U.S. Pat. No. 3,698,565, the slatwall defines upstanding ridges from which complementary hooks may hang, and forwardly of which baskets or the like may be positioned. Other slatwall constructions, such as that shown in Halverson, U.S. Pat. No. 4,825,601, use extrusions such as aluminum extrusions, which define slots into which the upper rear ends of brackets or display fixtures may be inserted, and in which the display fixtures project forwardly therefrom for merchandising. In Halverson, U.S. Pat. No. 4,825,601, individual, vertically stacked modules are provided but are secured in a vertically spaced array by face board panels. The modules and panels are typically secured via fasteners through their backs, requiring access to the rear side of the wall on which the slatwall system is to be positioned.

Still other prior art constructions, as shown by Johns, U.S. Pat. No. 4,323,163, provide modular arrays of members which may be interlocked and assembled into panels having a series of parallel, horizontal slots in both exterior surfaces and which may be made in variable horizontal and vertical dimensions.

There remains a need for an improved modular slatwall system which can easily be pre-assembled and which, when desired, can be mounted as a unit to a wall, all without requiring access to the rear of the wall or framing to which the slatwall is to be mounted, and which system accommodates standard one-quarter inch offset slatwall and pegboard hardware and display fixtures.

SUMMARY OF THE INVENTION

In accordance with the present invention, there is provided a slatwall panel having a top, bottom and sides, and comprising a plurality of elongated, horizontally disposed extruded slatwall members associated with each other in a vertical array. Each slatwall member has a pair of opposite ends and each of the members comprises a horizontally extending face panel. A rearwardly extending claw is provided at the top of the member, each member defining a recess adjacent the bottom of the member, the recess being defined by a depending front flange, a rearwardly spaced back flange, and a forwardly extending tongue, and the depending front flange and the tongue defining an access opening for support hooks or the like to be seated within the recess. The claw defines a formation for slidably engaging the tongue and for restraining the tongue against removal therefrom except by slidingly disengaging the claw and the tongue. The front flange has a rear face which is offset from the surface of the face panel by one-quarter inch, whereby standard one-quarter inch offset hardware and display fixtures may be functionally associated with the slatwall panel. In a preferred form, the claw includes a sawtooth extending along the length of the member and each panel mounts a U-shaped channel at each side, each U-shaped channel embracing one of the ends of each member, and means are provided for permanently securing the channels to the members to maintain the integrity of the panel.

In another aspect of the invention, a method of providing a slatwall panel for a wall is provided. It comprises the steps of making a slatwall panel having a top, bottom and sides, and comprising a plurality of elongated, horizontally disposed extruded slatwall members associated with each other in a vertical array, each slatwall member having a pair of opposite ends, each of the members comprising a horizontally extending face panel, and a rearwardly extending claw at the top of the member, each member defining a recess adjacent the bottom of the member, the recess being defined by a depending front flange, a rearwardly spaced back flange, and a forwardly extending tongue having a formation thereon, and the depending front flange and the tongue defining an access opening for support hooks or the like to be seated within the recess, the claw defining a formation for slidably engaging the tongue and for restraining the tongue against removal therefrom except by slidingly disengaging the claw and the tongue, and the front flange having a rear face which is offset from the surface of the face panel by one-quarter inch, whereby standard one-quarter inch offset hardware and display fixtures may be functionally associated with the slatwall panel; fixedly securing a mounting means to a wall in a horizontal orientation, the mounting means having a forwardly extending flange like the forwardly extending tongue; sliding a panel claw onto the forwardly extending flange formation; and anchoring the panel to a wall through a rearwardly spaced back flange.

In yet another form, a method of mounting a slatwall system to a wall comprises the steps of providing a plurality of elongated, horizontally disposed extruded slatwall members, each slatwall member having a pair of opposite ends, each of the members comprising a horizontally extending face panel, and a rearwardly extending claw at the top of the member, each member defining a recess adjacent the bottom of the member, the recess being defined by a depending front flange, a rearwardly spaced back flange, and a forwardly extending tongue having a formation thereon, and the depending front flange and the tongue defining an access opening for support hooks or the like to be seated within the recess, the claw defining a formation for slidably engaging the tongue and for restraining the tongue against removal therefrom except by slidingly disengaging the claw and the tongue, the front flange having a rear face which is offset from the surface of the face panel by one-quarter inch, whereby standard one-quarter inch offset hardware and display fixtures may be functionally associated with the member; fixedly securing a mounting means to a wall in a horizontal orientation, the mounting means having a forwardly extending flange, the front flange having a formation thereon like that of the tongue; sliding a member claw onto the forwardly extending flange formation; sliding a subsequent member claw onto a tongue of a next preceding member until the vertical height of the slatwall system is suitable, the forwardly extending flange and the tongues each restraining removal of the next adjacent panel except by slidingly disengaging the claw therefrom; and anchoring each member to the wall through a rearwardly spaced back flange thereof.

BRIEF DESCRIPTION THE DRAWINGS

DETAILED DESCRIPTION

Figure 1:
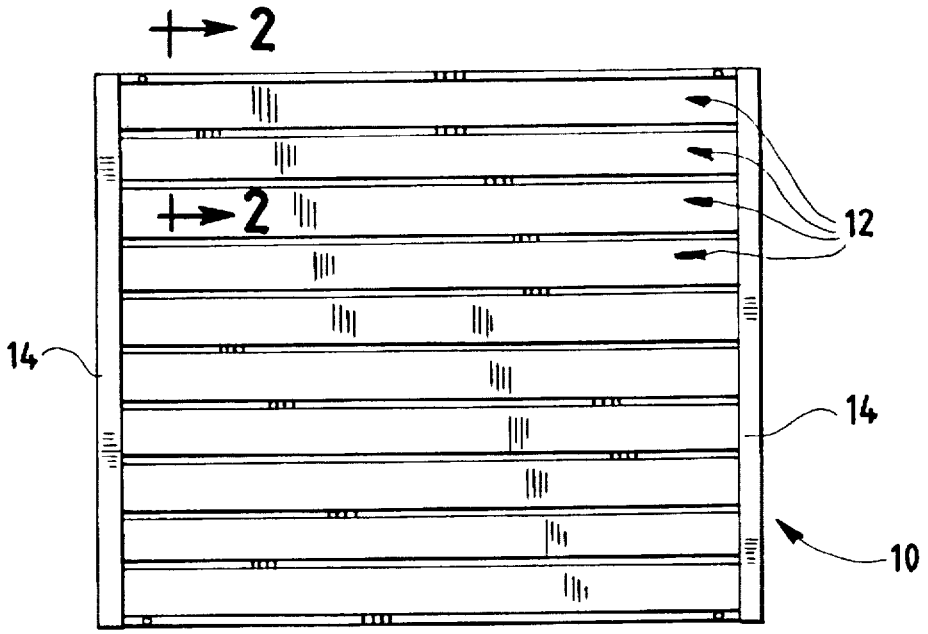
FIG. 1 is front plan view of a slatwall panel of the present invention.

Referring now to the drawings, FIG. 1 shows a typical slatwall panel 10 made in accordance with the present invention. Panel 10 is self sustaining and is adapted to be wall mounted. It comprises a series of elongated interconnected slatwall members 12 which are secured in a vertically stacked array, and the side edges of which are framed by U-shaped finish channels 14.

Each of the slatwall members 12 desirably comprises a horizontally disposed aluminum extrusion defining a face panel 20 having a front surface 21 and an upper, rearwardly extending claw 22. Claw 22 comprises a lower, rearwardly extending flange 24 and an upper, rearwardly extending toothed flange 26. Toothed flange 26 defines, in cross-section, an L-shaped sawtooth 28 which extends along the length of the elongated member 12 and which faces flange 24.

The face panel 20 terminates at its lower reaches in a flange such as a U-shaped return 30 having a rear face 31. Flange 30 confronts a downwardly facing recess 32. Recess 32 is enclosed by a back flange 34 having a front face 35 which lies parallel to face panel 20. Rear face 31 of the flange 30 which provides the front face 31 of the recess 32 is parallel to and is offset from the front surface 21 of the face panel 12 by one-quarter inch. As such, standard one-quarter inch offset hardware and display fixtures may be functionally associated with the slatwall panel 10.

At its lower end, flange 34 is provided with a forwardly extending tongue 36. Tongue 36 and flange 30 define an access opening 37 for support hooks or the like to be seated within the recess. Tongue 36 defines an upwardly facing, generally L-shaped tooth 38. Tooth 38 extends along the length of member 12. Tooth 38 is generally complementary to sawtooth 28 and is adapted to be slidably received thereagainst. Tongue 36 and claw 22 are proportioned so that they may slide relative to each other. They are proportioned so that they may not be separated from each other or assembled with each other, other than by sliding them relative to each other; i.e., are retained against removal except by slidingly disengaging the claw 22 and the tongue 36.

Thus, it will be apparent that a panel 10 comprising an array of members 12 of a desired length may be formed by sliding a series of the members 12 together via their respective pairs of claws 22 and tongues 36.

Figure 4:
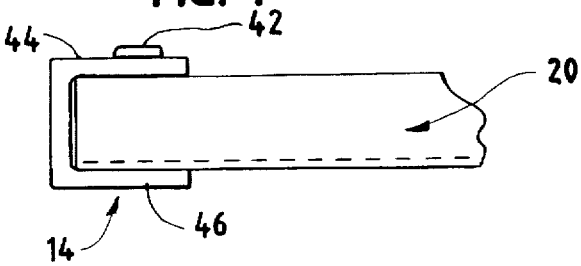
FIG. 4 is a fragmentary top view of a panel of FIG. 1.

As an example, a panel 10 approximately 27 inches by 27 inches may be made by using members 12 which are 27 inches in length and which use nine members 12 which are three inches in their vertical dimensions, and which are slid together as described. To integrate the members 12 in the unitary panel 10, a pair of U-shaped channels 14, each about 27 inches in length (in height), are provided, one for each side of the vertical array of members 12. The channels 14 are dimensioned so that they frictionally engage and grip the adjacent edges of members 12. To finish the assembly of panel 10, rivets 42 (FIG. 4) may be secured at several locations to maintain the integrity of the panel. Rivets 42 preferably extend through the rear channel legs 44 and associated member flanges 34, thereby avoiding defacing of the front channel legs 46.

Figure 5:
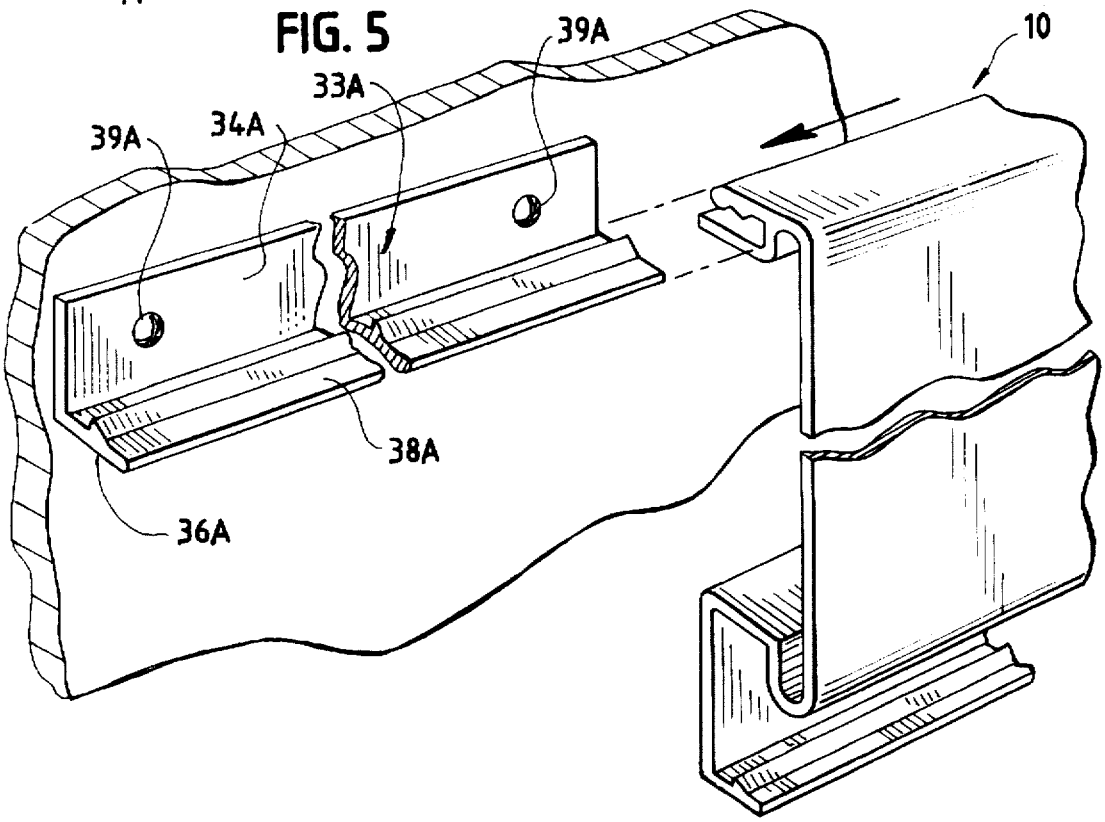
FIG. 5 is a fragmentary exploded perspective view illustrating a method of mounting a panel of the present invention to a wall.

The panel 10 may be secured to a wall in a variety of ways. For example, mounting means such as a mounting strip 33A or a plurality of spaced mounting clips comprising segments of a mounting strip 33A carrying a flange segment 34A and a forwardly extending flange or tongue 36A, formed with a tooth 38A (like tooth 38) may be fixedly wall mounted with screws 39A in a horizontal orientation. A panel 10, which has its side channels 14 sufficiently retracted to allow the claw of a panel 10 to be slid onto the tongue of the mounting strip 33A, may then be slidably associated therewith, as is illustrated by FIG. 5. The panel 10 may then be anchored to the wall as via fasteners 39 through the back flanges 34 of the recesses. The slatwall panel may be used by mounting hardware and display fixtures via hooks inserted in the recesses 32.

Figure 2:
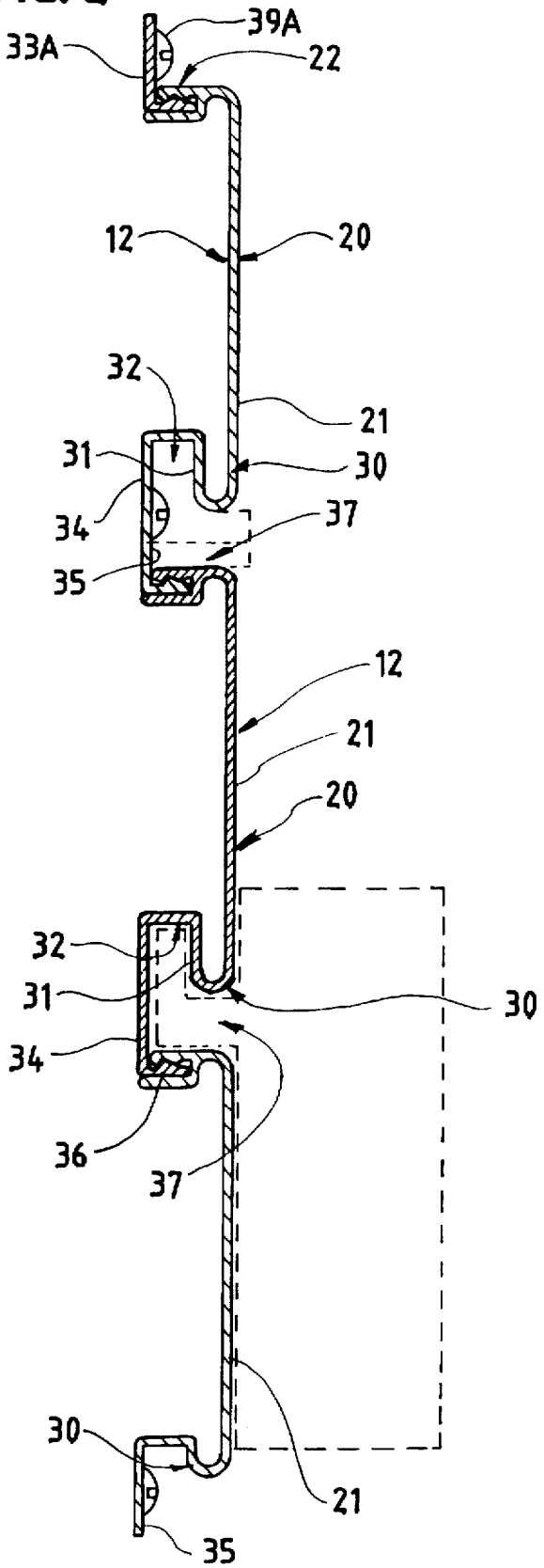
FIG. 2 is a cross-sectional view of the slatwall panel of FIG. 1, taken substantially along line 2—2 of FIG. 1.
Figure 3:
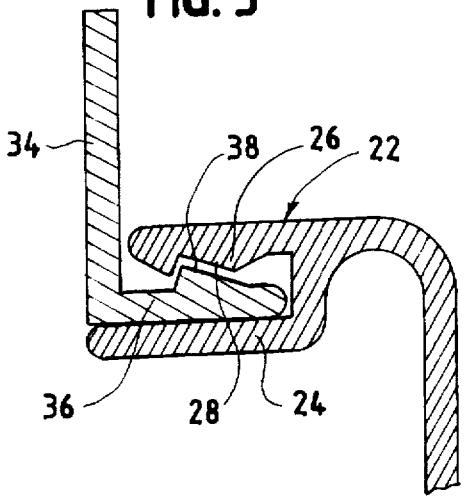
FIG. 3 is an enlarged fragmentary view of FIG. 2.

As will be appreciated from the foregoing, the slatwall system of the present invention is adapted for preassembly as a unit for subsequent securance to a wall W or the like, as described. It is also adapted to assembly on-site to a wall. As such, as shown by FIG. 2, a mounting means or strip 33A may be affixed in a horizontal orientation to a wall as by screws 39A. A first member 12 may then be slid onto the forwardly extending flange 36A of the strip 33A as described. A second member 12 and subsequent members may then be slid in place by associating the claws 22 and tongues 36 as described until the vertical height of the system is suitable. Suitable screws or other fasteners 35 may be applied through the flanges 34 to support the slatwall system and to anchor it to a wall.

Unlike conventional slatwall constructions, such as wooden slatwall constructions which weigh as much as 3 pounds per square foot, and which are not fire resistant, the slatwall system of the present invention typically weighs only about 1.25 pounds per square foot and is of a Class A fire-resistant construction, is reusable and is recyclable. The slatwall construction of the present invention is adapted for use with and compatible with all existing conventional one-quarter inch offset slatwall hardware and display attachments, as well with ¼ inch pegboard hardware, namely hardware and display attachments which utilize hook configurations which are offset by onequarter inch from the rear support shoulders of the hardware and display fixtures which bear against the face of the slatwall panels. The slatwall system may use members of different heights, such as 2", 3", 4", etc. No other available slatwall construction has this unique combination of highly advantageous features.

It will be apparent from the foregoing description that further embodiments of the invention may be made without departing from the spirit and scope of the present invention. Accordingly, the invention is not to be limited except as may be required by the appended claims.

What is claimed is:

1. A slatwall panel having a top, bottom and sides, and comprising a plurality of elongated, horizontally disposed extruded slatwall members associated with each other in a vertical array, each said slatwall member having a top, a bottom and a pair of opposite ends, each of said slatwall members comprising a horizontally extending face panel defining a front surface, and a rearwardly extending claw at the top of the slatwall member, each said slatwall member defining a recess adjacent the bottom of the slatwall member, said recess being defined by a depending front flange, a rearwardly spaced back flange, and a forwardly extending tongue, and said depending front flange and said tongue defining an access opening for support hooks to be seated within said recess, said claw defining a formation for slidably engaging said tongue and for restraining said tongue against removal therefrom except by a slidingly disengaging said claw and said tongue; and said front flange having a rear face which is offset from the front surface of said face panel by one-quarter inch, whereby standard one-quarter inch offset hardware and display fixtures may be functionally associated with said slatwall panel.

2. A slatwall panel in accordance with claim 1, and wherein said claw includes a sawtooth extending between the opposite ends of said slatwall member.

3. A slatwall panel in accordance with claim 1, and wherein each said slatwall panel mounts a U-shaped channel at each side, each said U-shaped channel embracing one of the ends of each said slatwall member, and means permanently securing said channels to said slatwall members to maintain the integrity of said slatwall panel.

4. A method of providing a slatwall panel for a wall, comprising the steps of:

making a slatwall panel having a top, bottom and sides, and comprising a plurality of elongated, horizontally disposed extruded slatwall members associated with each other in a vertical array, each said slatwall member having a top, a bottom and a pair of opposite ends, each of said slatwall members comprising a horizontally extending face panel defining a front surface and a rearwardly extending claw at the top of the slatwall member, each said slatwall member defining a recess adjacent the bottom of the slatwall member, said recess being defined by a depending front flange, a rearwardly spaced back flange, and a forwardly extending tongue, and said depending front flange and said tongue defining an access opening for support hooks to be seated within said recess, said claw defining a formation for slidably engaging said tongue and for restraining said tongue against removal therefrom except by slidingly disengaging said claw and said tongue, and said front flange having a rear face which is offset from the front surface of said face panel by one-quarter inch, whereby standard one-quarter inch offset hardware and display fixtures may be functionally associated with said slatwall panel, fixedly securing a mounting means to a wall in a horizontal orientation, said mounting means having a forwardly extending flange like said forwardly extending tongue, sliding a said claw onto said forwardly extending flange, and anchoring said slatwall panel to said wall through a rearwardly spaced back flange.

5. A method in accordance with claim 4, and wherein said claw includes a sawtooth for slidably engaging said forwardly extending flange.

6. A method in accordance with claim 4, and further comprising the step of mounting a U-shaped channel at each side of the slatwall panel, each said U-shaped channel embracing one of the ends of each said slatwall member and permanently securing said channels to said slatwall members to maintain the integrity of said slatwall panel.

7. A method of mounting a slatwall system to a wall, comprising the steps of:

providing a plurality of elongated, horizontally disposed extruded slatwall members, each said slatwall member having a top, a bottom and a pair of opposite ends, each of said slatwall members comprising a horizontally extending face panel defining a front surface, and a rearwardly extending claw at the top of the slatwall member, each said slatwall member defining a recess adjacent the bottom of the slatwall member, said recess being defined by a depending front flange, a rearwardly spaced back flange, and a forwardly extending tongue, and said depending front flange and said tongue defining an access opening for support hooks to be seated within said recess, said claw defining a formation for slidably engaging said tongue and for restraining said tongue against removal therefrom except by slidingly disengaging said claw and said tongue, said front flange having a rear face which is offset from the front surface of said face panel by one-quarter inch, whereby standard one-quarter inch offset hardware and display fixtures may be functionally associated with said slatwall member, fixedly securing a mounting means to a wall in a horizontal orientation, said mounting means having a forwardly extending flange, said front flange having a formation like that of said tongue sliding a claw of a member onto said forwardly extending flange, sliding a claw of a subsequent member onto a tongue of a next preceding slatwall member until the vertical height of the slatwall system is of a suitable height, said forwardly extending flange and said tongues each restraining removal of the next adjacent slatwall member except by slidingly disengaging said claw therefrom, and anchoring each said slatwall member to said wall through a rearwardly spaced back flange thereof.

8. A method in accordance with claim 7, and wherein each of said claws includes a sawtooth for slidably engaging said forwardly extending flange and tongues.

9. A method in accordance with claim 7, and further comprising the step of mounting a U-shaped channel at each end of the slatwall members for embracing the ends of the slatwall members, and permanently securing said channels to said slatwall members.

* * * * *